United States Patent [19]

Koperdak

[11] Patent Number: 4,690,382

[45] Date of Patent: Sep. 1, 1987

[54] COVING ATTACHMENT

[75] Inventor: Edward A. Koperdak, Kalamazoo, Mich.

[73] Assignee: Cope, Inc., Schoolcraft, Mich.

[21] Appl. No.: 812,503

[22] Filed: Dec. 23, 1985

[51] Int. Cl.[4] ..... E04H 17/00

[52] U.S. Cl. ..... 256/1; 256/32

[58] Field of Search ..... 256/32, 1, 33; 47/33

[56] References Cited

U.S. PATENT DOCUMENTS

| | | | |
|---|---|---|---|
| 3,393,897 | 7/1968 | Wright | 256/32 |
| 3,713,624 | 1/1973 | Niemann | 256/43 |
| 3,724,128 | 4/1973 | Tabone | 47/33 |
| 3,768,780 | 10/1973 | Cowles | 256/1 |
| 3,841,022 | 10/1974 | Thodos | 47/33 |
| 4,478,391 | 10/1984 | Kovach | 256/32 X |
| 4,497,472 | 2/1985 | Johnson | 256/32 |
| 4,515,349 | 5/1985 | Groves | 256/32 X |
| 4,548,388 | 10/1985 | Cobler | 256/32 |

*Primary Examiner*—Andrew V. Kundrat

*Attorney, Agent, or Firm*—Reising, Ethington, Barnard, Perry & Milton

[57] ABSTRACT

A one-piece coving strip (10) of the type utilized along fences, rails, or the like, for preventing vegetation growth at the base thereof, comprises an upper fence-engaging portion (22) and a lower ground-engaging portion (24), joined together by curved connections (26,28). The invention is characterized by including attachment fingers (62) or slits (30,36) for directly attaching the upper portion (22) to a chain-link fence (16). The strip (10) covers an area of ground between the fence and the ground-engaging portion (24), preventing vegetation growth and the passage of objects thereunder, as well as the easier removal of litter from the fencing. Optionally, anchoring spikes (38) may be provided for anchoring the lower portion (24) to the ground.

11 Claims, 9 Drawing Figures

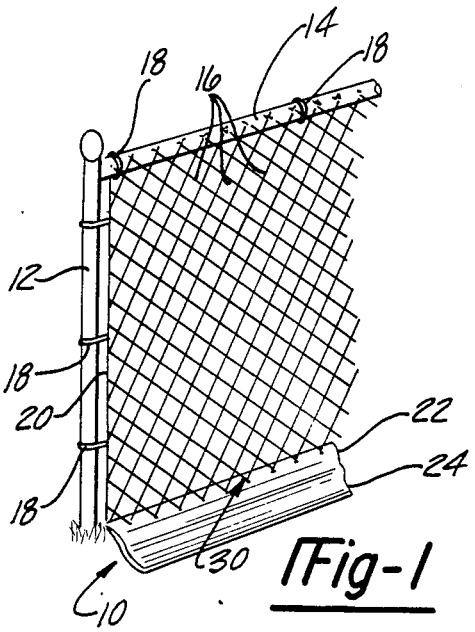
Fig-1
Fig-2
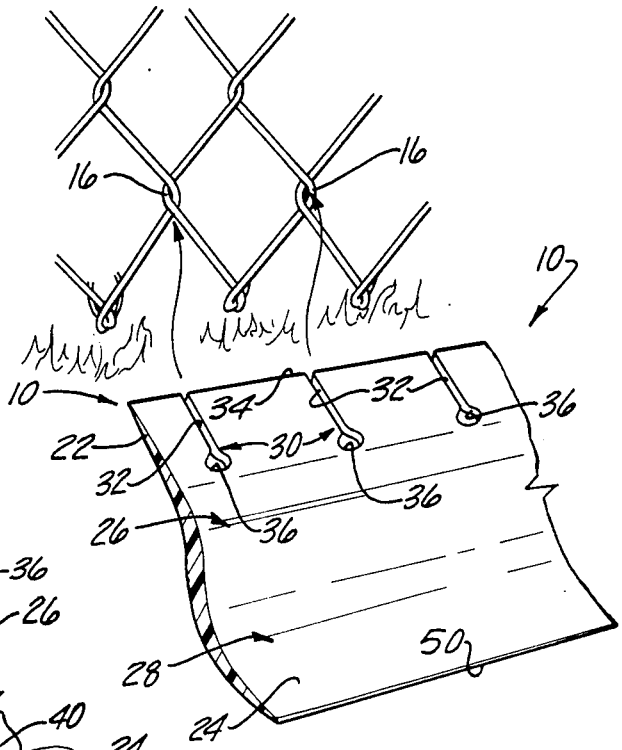
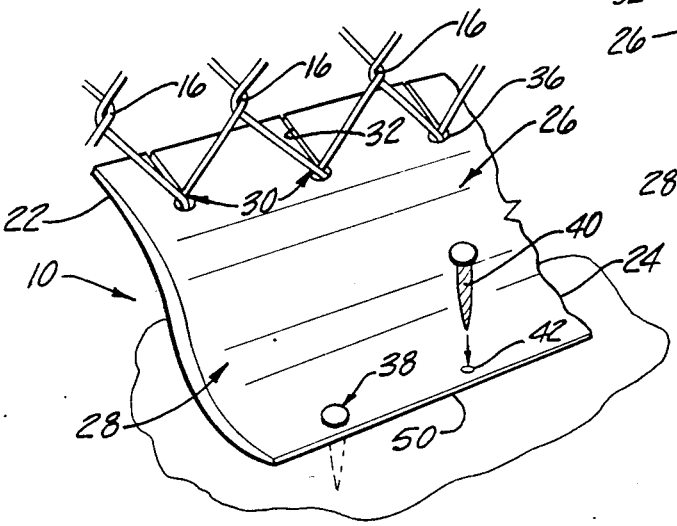
Fig-3
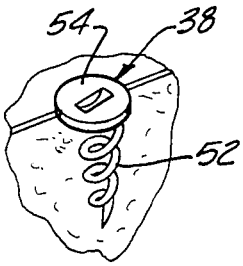
Fig-6
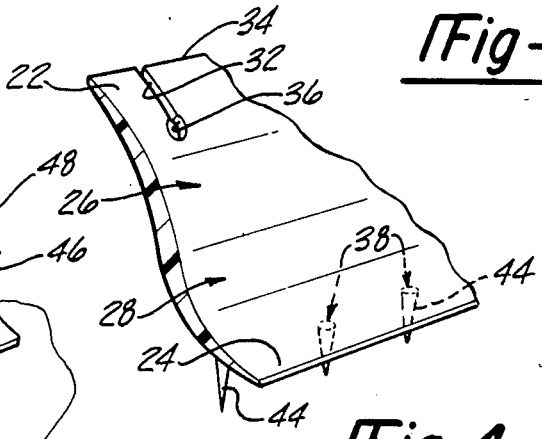
Fig-4
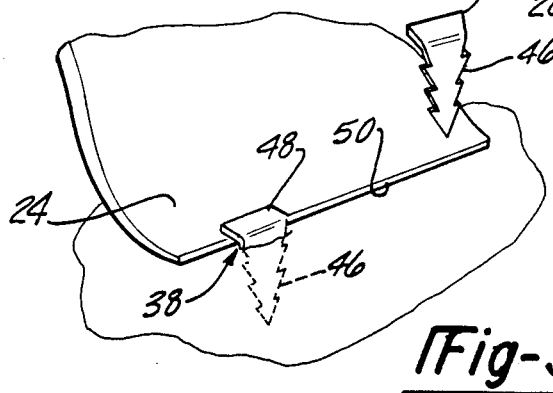
Fig-5

COVING ATTACHMENT

TECHNICAL FIELD

The invention relates to coving material for fences or other barriers to prevent grass from growing near the base thereof, or the passage of objects thereunder.

BACKGROUND OF THE INVENTION

Presently, grass growing at the base of all types of fencing, especially chain-link, is difficult to maintain. Typically, special mowing devices or weed killers must be used to keep grass and other weeds from growing up along one or both sides of a fence. Further, leaves and other litter tend to stick in the bottom of the fence, becoming difficult to remove.

U.S. Pat. No. 3,713,624 discloses an edging assembly specifically designed to be used on both sides of a chain-link fence to restrict the growth of vegetation. U.S. Pat. No. 4,497,472 discloses a similar fence guard.

Another specific and related problem is the tendency of balls, for example tennis balls and baseballs, to pass under a backstop or other boundary fence during play.

Another problem is the seepage of of water into joints of concrete highway abutments.

A deficiency of these and other prior art devices is that many uses only require coving on one side of a fence. There are also problems with keeping the ground-engaging portion of the edging material flat to the ground. The prior art typically utilizes short strips of edging material fastened together end-to-end in order to accommodate posts, often relying upon separate pieces of edging material passing underneath the fence from both sides thereof to surround the fence post.

SUMMARY OF INVENTION AND ADVANTAGES

According to the instant invention, a coving strip of the type utilized along fences, rails or the like, for preventing vegetation growth at the base thereof, comprises an upper fence-engaging portion and a lower ground-engaging portion, joined together by curved connections. The invention is characterized by attachment means for directly attaching the upper portion to a fence, rail or the like, so as to cover an area of ground between the fence and the ground-engaging portion, preventing vegetation growth and the passage of objects thereunder.

An advantage of the instant invention is that the strip need not be cut into lengths to fit under a fence between fence posts.

Another advantage of the instant invention is that the strip may be attached on either or both sides of a fence, rail, barrier, or the like, by attachment means integral with the strip, requiring no additinal moving parts for installation.

A further advantage of the instant invention is that the installed coving strip allows passage of a lawn mower wheel thereover, making it easier to cut grass adjacent the strip; moreover, leaves and other litter tending to accumulate at the base of the fence does not become lodged therein and, hence, is removed more easily.

FIGURES IN THE DRAWINGS

Other advantages of the present invention will be readily appreciated as the same becomes better understood by reference to the following detailed description when considered in connection with the accompanying drawings wherein:

FIG. 1 is a perspective view of the invention in place at the base of a chain-link fence;

FIG. 2 is an enlarged perspective view of the invention showing the coving strip prior to attachment to the base of a chain-link fence;

FIG. 3 is an enlarged perspective view of the invention attached to the bottom of a chain-link fence and shown with an anchoring means;

FIG. 4 is an enlarged fragmentary view of the invention showing an alternative form of anchoring means;

FIG. 5 is a fragmentary view of the invention showing another form of anchoring means;

FIG. 6 is an enlarged fragmentary view of the invention showing yet another form of anchoring means;

DETAILED DESCRIPTION OF THE PREFERRED EMBODIMENTS

Figure 7:
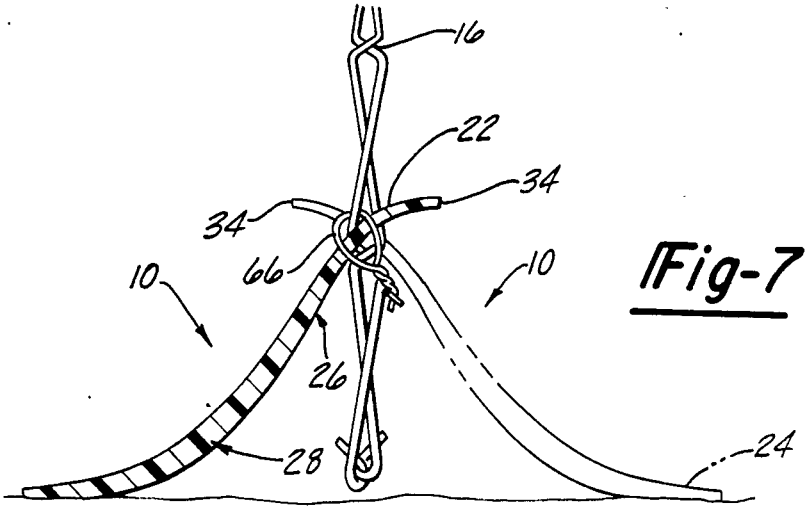
FIG. 7 is a side view of the invention adapted to be attached to both sides of a fence.

According to the instant invention, there is provided a coving strip, generally shown at 10, utilized along the bottom of a chain-link fence, shown in FIGS. 1, 2, 3 and 9, for preventing vegetation growth at the base thereof and the passage of objects thereunder.

In FIG. 1, a chain-link fence of common construction has a plurality of fence posts 12 and a top rail 14 between which a mesh portion comprised of intertwined wires 16 is suspended in a conventional manner, such as the wires 18 and retaining bar 20 shown. A one-piece coving strip 10 constructed in accordance with the instant invention comprises an upper fence-engaging portion 22 and a lower ground-engaging portion 24, joined together by curved connections in the areas designated by numerals 26 and 28, respectively. The invention is characterized by attachment means, generally indicated at 30, for directly attaching said upper portion 22 to the mesh portion 16 of the fence, a rail, or the like, so as to cover an area of ground between the fence and said groundengaging portion 24, preventing vegetation growth and the passage of objects, such as tennis balls, golf balls or baseballs, thereunder.

With reference to FIGS. 2 and 3, the attachment means 30 preferably comprise a series of slits 32 formed in the fence-engaging portion 22. Each of the slits 32 extend inwardly from a top edge 34 of the fence-engaging portion and terminate in a retaining eyelet 36. The spacing of the slits is designed to correspond to the diagonal distance between intertwined pairs of wires 16 in standard chain-link fencing, as illustrated in the arrows in FIG. 2 wherein the coving strip 10 is shown in position with each of the slits in registration and ready to receive corresponding pairs of intertwined wires 16 of the mesh portion of the fence. In FIG. 3, the coving strip 10 is shown installed by the intertwined link 16 being received through the slits and retained in an associated eyelet 36.

In FIGS. 3 through 6, there is shown various forms of anchoring means 38 for anchoring said lower portion 24 to the ground. Particularly, in FIG. 3, a spike 40 is received in an aperture 42 (arrows) and driven into the ground to hold the lower portion 24 in engagement with the ground. In FIG. 4, the anchoring means 38 takes the form of a plurality of sharpened pegs 44 projecting downwardly from and integrally formed with the underside of the ground-engaging portion 24. The pegs or projections 44 may be driven into the ground by pressure or impact force exerted on the top side of the ground-engaging portion 24. In FIG. 5, a plurality of barbed stakes 46 having bent heads 48 to engage and urge the bottom edge 50 of the ground-engaging portion 24 downwardly when the stake 46 is driven (arrow) into the ground. In FIG. 6, the anchoring means 38 takes the form of a cork screw having an augered portion 52 driven into the ground to engage the head 54 with the bottom edge 50 of the ground-engaging portion 24.

Figure 8:
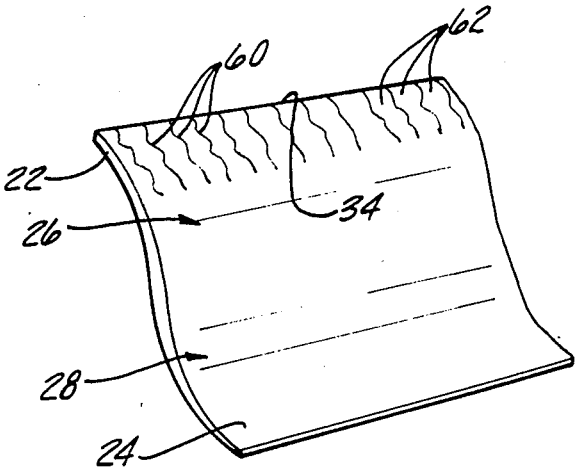
FIG. 8 is a perspective view of the invention showing an alternative means of attachment.

In FIGS. 7 and 8, another form of attachment means is disclosed. FIG. 8 shows a plurality of serrated cuts 60 extending inwardly from the top edge 34 of the fence-engaging portion 22, defining a series of undulatory fingers 62 for receiving and retaining intertwined pairs of fence wires 16 therebetween. Referring to FIG. 7, a coving strip 10 can be attached to both sides of a wire fence by alternately providing notched openings between fingers 34 along the top edge 34 of each coving strip 10, so that each of the fingers 64 is alternately received within the respective opening of the other coving strip. The fingers 64 can either be undulatory, as shown in FIG. 8 where no spaces are provided between the fingers, or can have straight edges and be secured together at the fence-engaging portion 22 by a wire 66 passing through apertures in each of the coving strips 10. Where the alternatively spaced fingers on each of the coving strips 10 (FIG. 8) have an undulatory configuration, the fingers will interlock and retain one another with the fence link 16 therebetween.

An additional attachment means (not shown) between a pair of strips could include a series interleaving elongated apertures and notched or T-shaped projections formed atlernately along a top edge of each of said upper fence-engaging portions, with the projections on one of said strips being received and retained within an opposing one of said apertures on the other of said strips to secure said coving strips together.

Figure 9:
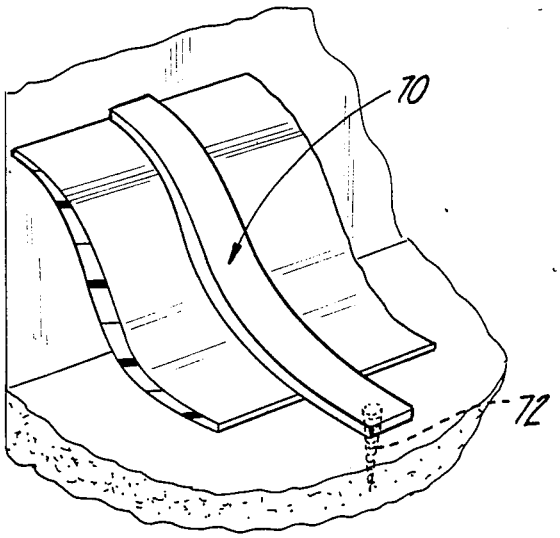
FIG. 9 is a perspective view of the invention showing the use of a brace member used with a strip.

For nonchain-link fencing applications, a transverse brace, generally shown at 70 in FIG. 9, conforming to the external contour of the coving strip, is applied to the outside of the strip, urging the strip against the fence or barrier. The brace 70 may be either of metal or plastic and may have a stake 72 formed at its ground-engaging end and optionally a fastener at the fence-engaging end.

The structure of the coving strip 10 has heretofore been described as comprising an upper fence-engaging portion 22 and a lower ground-engaging portion 24 joined together by curved connections 26,28; as can be seen from the drawings, the lower portion 24 has a greater thickness than said upper portion 22, biasing said lower portion downwardly to engage the ground, even in the absence of an anchoring means such as that set forth above. The coving strip has an undulatory and substantially S-shaped or stepped cross section and may be formed with notches or simply perforations extending between an adjacent pair of slits 32 at uniform intervals along the length of the strip to correspond to conventional spacing of the fence posts of a typical fence, barrier 58 or the like.

The one-piece strip may be formed, by any number of existing extrusion processes, from vinyl, e.g. polyvinyl chloride, or other plastics and can be stored in rolls.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A one-piece coving strip (10) of the type utilized along fences, rails, or the like, for preventing vegetation growth at the base thereof, comprising:

an upper fence-engaging portion (22) and a lower ground-engaging portion (24), joined together by curved connections (26,28) and characterized by attachment means (36) for directly attaching said upper portion by interlocking said portion with a fence (16), rail, or the like, so as to cover an area of ground between the fence and said ground-engaging portion, preventing vegetation growth and the passage of objects thereunder.

2. A coving strip as set forth in claim 1 further characterized by anchoring means (38) for anchoring said lower portion to the ground.

3. A coving strip as set forth in claim 2 further characterized by said anchoring means (38) including sharpened pegs extending downwardly from and formed integrally with the underside of said lower portion (24) and driven into the ground.

4. A covering strip as set forth in claim 2 further characterized by said anchoring means (38) comprising a spike (40) received through an aperture (42) in said lower portion (24) and driven into the ground.

5. A coving strip as set forth in claim 2 further characterized by said anchoring means (38) comprising a separate barbed stake (46) having a bent head (48) for engaging and urging a bottom edge (50) of said ground-engaging portion downward when said stake (46) is driven into the ground.

6. A coving strip as set forth in claim 1 further characterized by said attachment means (30). including a plurality of slits (32) extending inwardly from a top edge (34) of said fenceengaging portion (22) and terminating in an eyelet (36) for receiving and retaining a fence wire (16) therein.

7. A coving strip as set forth in claim 1 further characterized by said attachment means (38) including a plurality of serrated slits (60) extending inwardly from a top edge (34) of said fence-engaging portion (22), defining a series of undulatory fingers (62) for receiving and retaining a fence wire (16) therebetween.

8. A coving strip as set forth in claim 1 further characterized by said lower portion (24) having a less thickness than said upper portion (22), biasing said lower portion downwardly to engage the ground.

9. A coving strip as set forth in claim 1 further characterized by said coving strip (10) having an undulatory substantially S-shaped cross section.

10. A coving strip as set forth in claim 1 further characterized by notches formed along a top edge of said upper portion to receive a post (12) from a fence, barrier (58), or the like.

11. A coving strip as set forth in claim 1 further wherein said attachment means is characterized by a transverse brace (70) conforming to the external contour of said strip (10) and having a ground-engaging end with groundanchoring means (72) thereon and a fence-engaging end for urging said strip axially toward the fence and downwardly toward the ground.

* * * * *